United States Patent [19]

Burk et al.

[11] Patent Number: 4,910,979

[45] Date of Patent: Mar. 27, 1990

[54] COUNTER-ROTATION WASH SYSTEM

[75] Inventors: Jeffrey L. Burk, Lincoln Township, Berrien County; Douglas E. Wood, Hagar Township, both of Berrien County, Mich.

[73] Assignee: Whirlpool Corporation, Benton Harbor, Mich.

[21] Appl. No.: 292,823

[22] Filed: Jan. 3, 1989

[51] Int. Cl.[4] ..... D06F 23/04

[52] U.S. Cl. ..... 68/23.7; 68/133; 68/174

[58] Field of Search ..... 8/159; 68/23.7, 38, 68/54, 70, 71, 133, 154, 174

[56] References Cited

U.S. PATENT DOCUMENTS 2,301,046 11/1942 Henderson ..... 68/23.7

2,303,979 12/1942 Blake ..... 68/23.7 X 3,066,521 12/1962 Gillessen ..... 68/38 X 3,216,227 11/1965 Alger et al. ..... 68/23.7

3,648,486 3/1972 Rosinski, Jr. et al. ..... 68/154 X 3,771,336 11/1973 Phillips, Jr. ..... 68/23.7

*Primary Examiner*—Philip R. Coe

*Attorney, Agent, or Firm*—Hill, Van Santen, Steadman & Simpson

[57] ABSTRACT

A counter-rotation wash system is provided in an automatic washer wherein the basket and agitator are reversely oscillated during a wash mode and the basket and agitator are co-rotated during a liquid extraction or spin mode. A reversing PSC motor is connected through a planetary drive to both the agitator and basket with the basket being free from restraint during the agitate mode. Reduced torque requirements and other advantages accrue.

15 Claims, 4 Drawing Sheets

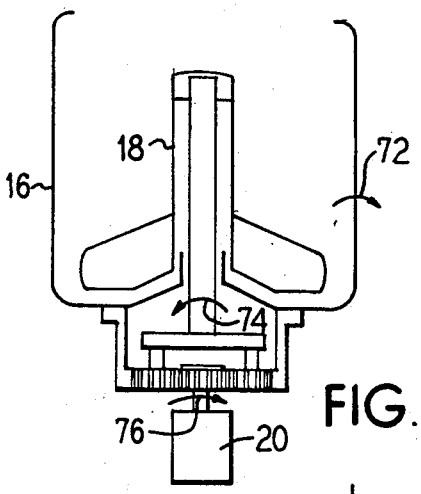
FIG. 6
FIG. 7
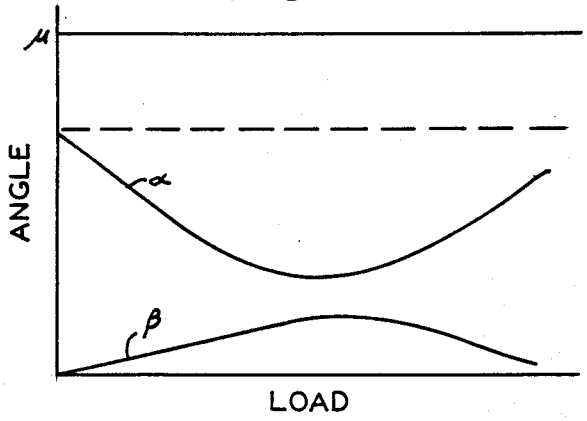
FIG. 8
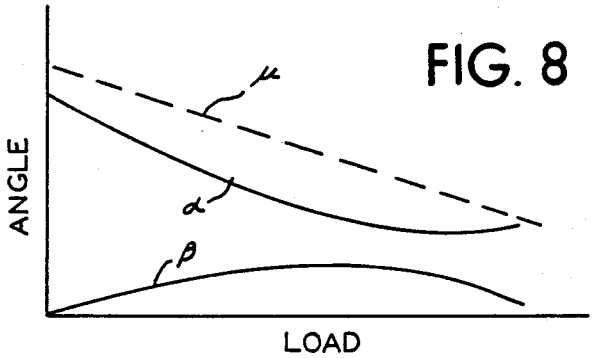
FIG. 9
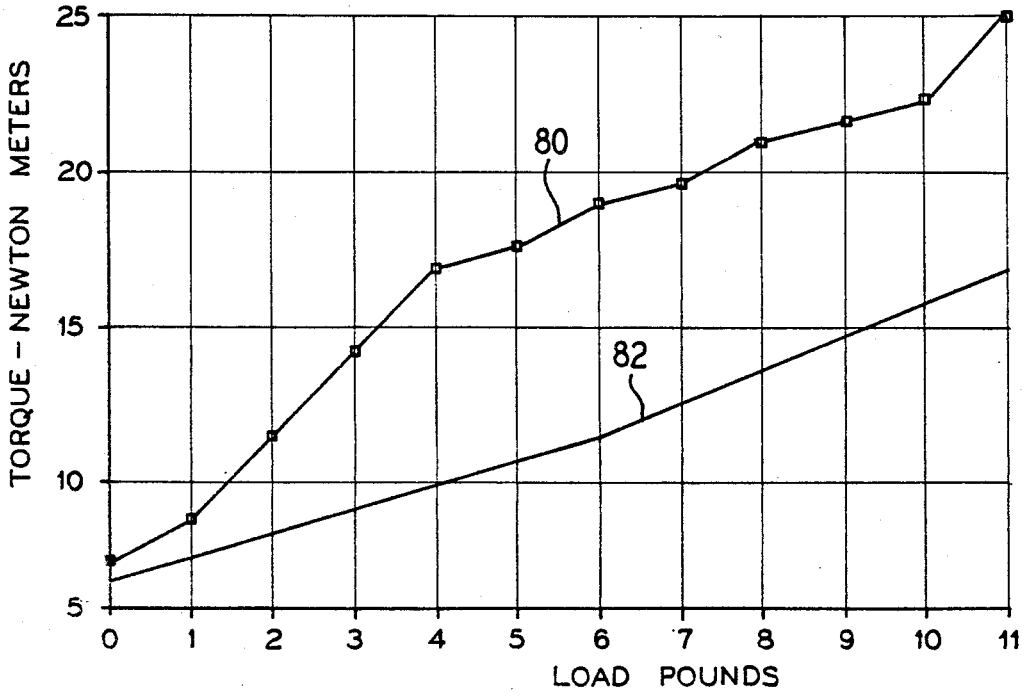

COUNTER-ROTATION WASH SYSTEM

BACKGROUND OF THE INVENTION

1. Field of the Invention

The present invention relates to an automatic clothes washer and more particularly to a vertical axis washer having an agitator and wash basket.

2. Description of the Prior Art

In conventional vertical-axis automatic washer, there is a central agitator which oscillates during the wash portion of the cycle within a wash basket holding the materials to be washed, the wash basket being held in a fixed position relative to the washer cabinet by a brake. For example, U.S. Pat. No. 3,216,227 discloses a direct drive motor that drives an agitator by means of the motor shaft and drives the basket by means of a coupling between the motor housing and the basket. The basket is locked by a brake mechanism during agitation.

In other constructions the basket does move during agitation, but either there is no agitator present, or else the basket moves with the agitator.

U.S. Pat. No. 3,066,521 discloses an automatic washer in which there is no vertical axis agitator, but rather the basket itself is rotated periodically during the wash operation to effect mechanical agitation of the clothes load.

U.S. Pat. No. 3,648,486 discloses an automatic washer wherein a central agitator is afixed to the basket and both the basket and agitator move together during the agitation prtion of the wash cycle.

SUMMARY OF THE INVENTION

The present invention provides a drive system for an automatic washer where a reversing drive system consisting of a reversing motor in the preferred embodiment, is coupled to a planetary gear set, the motor input being coupled the sun gear. A ring gear is directly coupled to the basket and a planet carrier output is coupled to the agitator. As the motor rotates in one direction, it drives the agitator in the same direction. Unlike conventional washer operation, however, the basket is not held stationary, that is, the basket brake is not engaged during agitation. With no fixed member to provide a reactionary force, the ring gear and basket are driven in a direction opposite to that of the agitator. When the motor reverses, so does the direction of the agitator and basket, resulting in a dual-agitation or counter-rotation between the agitator and basket. That is, the agitator and basket will always rotate or oscillate in opposite directions. Since the inertia of the basket is greater than that of the agitator, the basket will rotate much less than the agitator. A typical system may have an agitator stroke angle of 180°-240° and a basket rotation of 20°-60°. The amount of basket rotation is dependent upon the system nertia, friction, angle of agitator stroke, and clothes load size.

The advantages of such a system include a 25-40% reduction in agitate torque force requiredbby the motor for a given load size, elimination of the need for a brake or mechanical reaction force during agitation, lessening of the shock loading on gears, allowance for a uniform (symmetric) rotation of the basket during agitate, and elimination of tub motion during agitation.

BRIEF DESCRIPTION OF THE DRAWINGS

FIG. 6 is a schematic illustration showing the rotational inertias of the basket and agitator.

FIG. 7 is a graphic illustration of the amount of basket rotation relative to clothes load in the basket for a fixed motor angle input.

FIG. 8 is a graphic illustration of the amount of basket rotation relative to clothes load in the basket for a fixed motor torque input.

FIG. 9 is a graphic comparison of torque input required for varying load in a conventional wash versus torque input required in a washer incorporating the principles of the present invention.

DETAILED DESCRIPTION OF THE PREFERRED EMBODIMENTS

Figure 1:
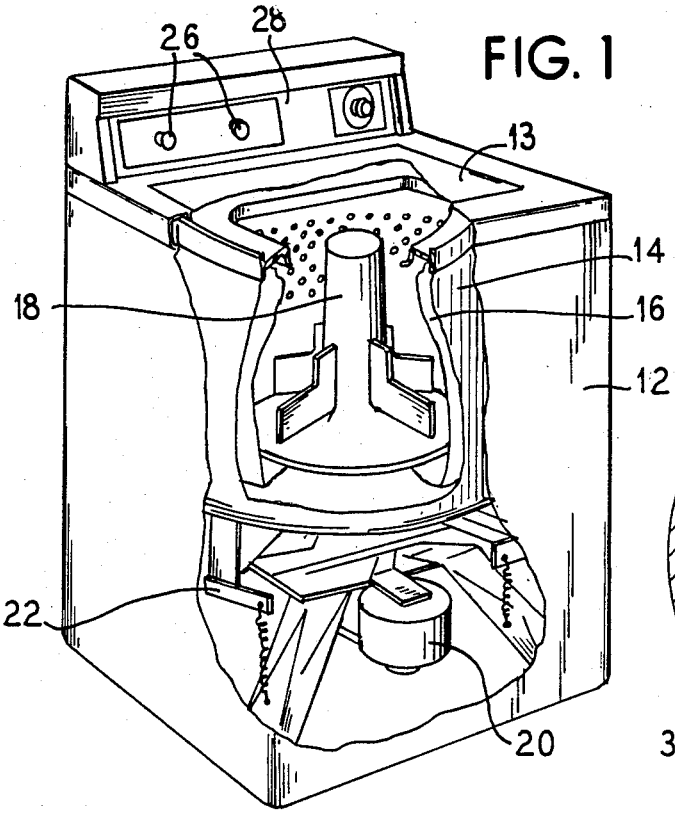
FIG. 1 is a perspective illustration of an automatic washer embodying the principles of the present invention.
Figure 5:
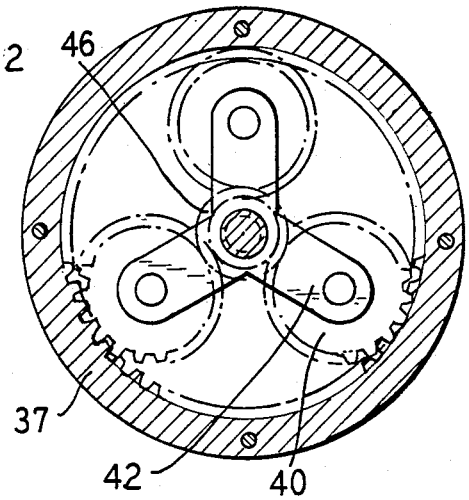
FIG. 5 is a sectional view taken generally along the line V-V of FIG. 4.

In FIG. 1 there is illustrated an automatic washer generally at embodying the principles of the present invention. The washer has an outer cabinet 12 with an openable lid 13 which encloses an imperforate wash tub 14 for receiving a supply of wash liquid. Concentrically mounted within the wash tub is a wash basket 16 for receiving a load of materials to be washed and a vertical axis agitator 18. A motor 20 is provided which is drivingly connected to the agitator 18 to drive it in an oscillatory or rotarymmanner and is also selectively connectable to the basket 16 to rotate or, in a preferred embodiment, to oscillate it. The assembly of tubs, agitator and motor is mounted on a suspension system 22. A plurality of controls 26 are provided on a control console 28 for automatically operating the washer through a series of washing, rinsing and liquid extracting steps as is well known in the art.

A reversible drive systemis provided which includes means for oscillatingly driving the agitator during a washing mode and means permitting said basket t rotate relative to the washer cabinet and the agitator in the washing mode. The means for oscillatingly driving the agitator preferably is operatively connected between the reversible drive system and the basket and agitator.

Figure 4:
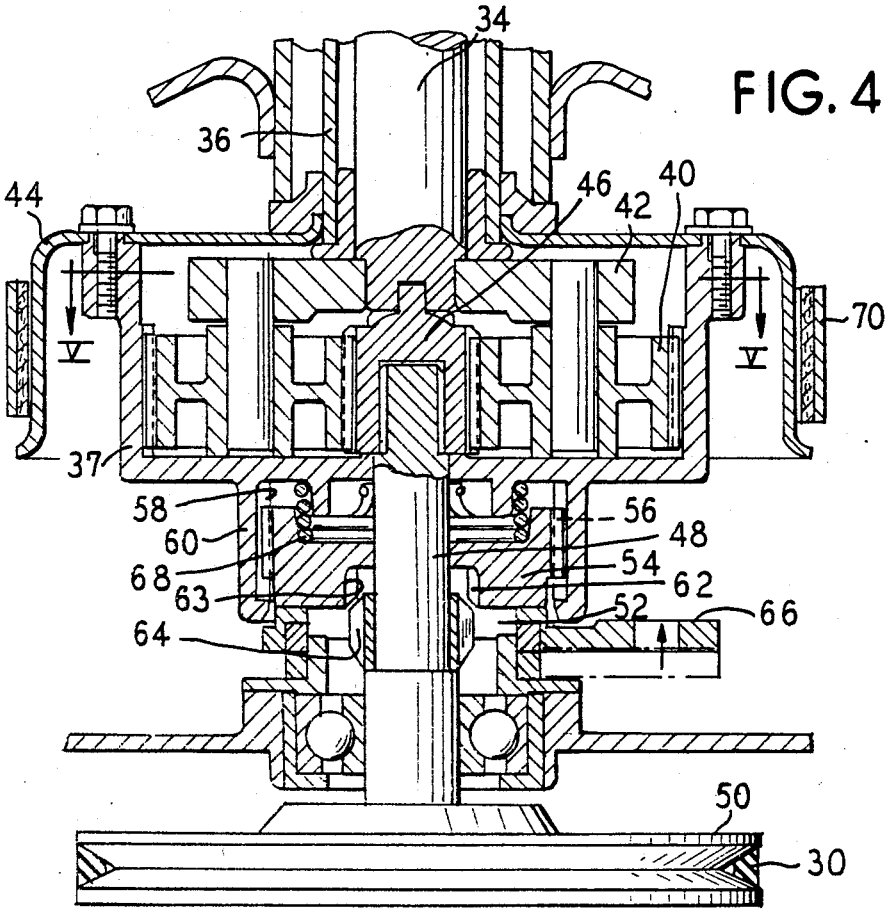
FIG. 4 is an enlarged sectional view of the planetary drive connection.
Figure 2:
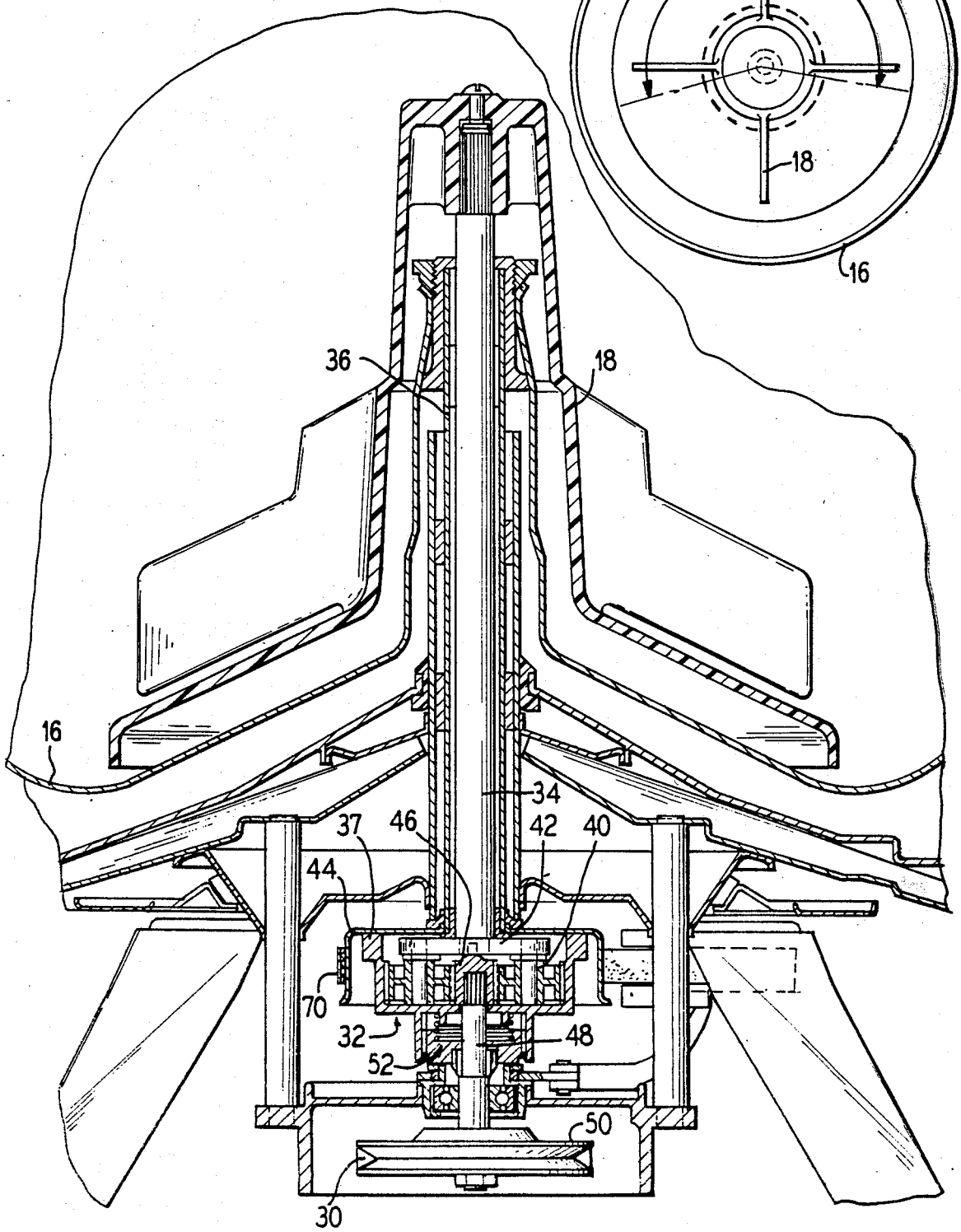
FIG. 2 is a side sectional view of the agitator and drive system of the washer of FIG. 1.

The preferred embodiment of a drive mechanism is shown in greater detail in FIGS. 2 and 4 where it is seen that the motor 20 is connected by means of a drive belt 30 through a gear arrangement, such as a planetary gear assembly 32, to a vertical shaft 34 connected to the agitator 18. Alternatively, the motor 20 may be directly coupled to the gear assembly 32. Also, other types of gear arrangements may be utilized to provide a drive means between the reversible drive system and the basket and agitator for selectively rotationally driving the agitator and basket in opposite and common directions. In this preferred embodiment, the motor 20 is a permanent split capacitor (PSC) motor which is to be reversely operated to provide the oscillatory motion to the agitator 18 and the basket 16. Alternatively, the wash basket 16 is connected via a spin tube 36 to the gear arrangement 32 such as to an outer ring gear 37 having an external hub surface 44. The vertical shaft 34 is connected to planet gears 40 through the use of a connecting carrier plate 42 and a sun gear 46 is directly connected to a shaft 48 connected to a pulley 50 which is rotated by the belt 30 connected to the motor 20.

Figure 3:
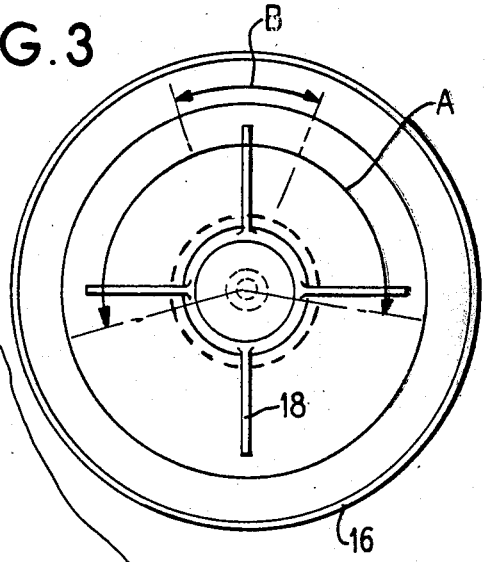
FIG. 3 is a top elevational view schematically illustrating movement of the agitator and basket during an agitate portion of the wash cycle.

When the washer is operating in the agitate mode, the motor 20 is operated in a reversing fashion which causes the shaft 48 to oscillate, thus driving the sun gear 46 in alternating opposite directions. The agitator is therefore oscillated through its connection with the planet gears 40 and the wash basket 16 is oscillated, rotationally opposite to the agitator, through its connection to the outer ring gear 37. Since the inertia of the basket 16 with its liquid and clothes load is greater than the inertia of the agitator, taking into account the effect of the clothes load, (FIG 6), the basket will rotate much less than the agitator. As FIG. 3 illustrates, the agitator, in a preferred embodiment may rotate through a stroke angle A of 180°-240° while the basket rotation angle B will be around 20°-60°.

Referring again to FIG. 4, when the washer is operating in the spin mode, a clutch 5 is provided to rotationally lock the ring gear 37 with the shaft 48 so that the basket 16 and the agitator 18 will spin together. The clutch includes an axially displaceable gear member 54 having teeth 56 on an outer circumference thereof which engage with corresponding teeth 58 on an annular axial extension 60 of the ring gear 37. The displaceable gear 54 has a plurality of axially aligned teeth 62 on an inner surface 63 thereof which are engageable with outwardly projecting axially aligned teeth 64 carried on the shaft 48. Axial movement of the gear 54 will selectively engage or disengage the gear teeth 62 with the shaft teeth 64. When the gear teeth 62 are engaged with the shaft teeth 64, the ring gear 37 will be rotationally locked to the shaft 48. When the teeth 62 are disengaged, the ring gear 37 will be free to rotate relative to the shaft 48.

An axially movable actuator arm 66 is provided to move the gear 54 away from the shaft teeth 64 when desired, such as in the agitate mode. A coil spring 68 is provided between the gear 54 and the ring gear 37 to urge the gear 54 back into engagement with the shaft teeth 64 to lock the ring gear 37 rotationally to the shaft 54, such as during the spin mode. FIG. 4 illustrates the position of gear 54 n the unlocked or agitate mode and FIG. 2 illustrates the position of the gear 54 in the locked or spin mode.

A band brake 70 is provided which encircles the hub surface 44 of the ring gear 37. This band brake, unlike band brake mechanisms in prior washers, is not operated when the washer is in the agitate mode, but rather is only operated when the lid 13 is open. During this event, the band is tightened to frictionally engage the hub and prevent its rotation, thereby preventing rotation of the basket.

In standard planetary drive arrangements, the drive force applied to the sun gear generally works against a reaction force represented by a fixed ring gear. It was expected that if the basket were unrestrained, thus removing the fixed reaction force, the agitator motion and stroke would drop off and uncontrollable basket motion would result. Suprisingly, however, in the arrangement of the present invention, a first torque load (arrow 72, FIG. 6) represented by the basket inertia and the effect of the water and clothes load on the basket balances with a second torque load (arrow 74) represented by the agitator inertia and the effect of the water and clothes load on the agitator to provide contrbl to the oscillating motion with the ratio of the torque loads providing the ratio of stroke angles. The effective sum of the first basket torque 72 and second agitator torque 74 equals through the gear reduction a torque input (arrow 76) of the motor 20.

In conventional systems, a portion of the energy output of the motor is lost due to the braking of the motion of the basket 16 as the agitator 18 oscillates. With the prssent arrangement, more of the energy goes into the wash system thereby permitting a reduced total energy consumption for an agitate cycle.

FIG. 9 shows a comparison of torque input for varying sized wash loads with line 80 representing the empirical test results for a conventional washer wherein the basket is braked during agitation and with line 82 representing the results for a washer incorporating the principles of the present invention wherein the basket is not braked. It is clear from the experimental results that torque input is substantially reduced when the basket is reversely driven relative to the agitator rather than merely braked.

The size of the clothes load has an effect on the ratio of rotationll movement as is illustrated in FIGS. 7 and 8 which show the amount of angular basket ($\alpha$), agitator ($\beta$) and motor shaft ($\upsilon$) movement as they relate to the changing of load size. FIG. 7 represents the results for the drive arrangement when the motor is operated for constant angle input while FIG. 8 represents a motor that reacts to the load by providing a reduced angle as the load increases.

With no clothes in the washer, there is no coupling between the agitator 18 and the basket 16 and there is minimal inertia of the agitator. Thus, most of the drive torque goes to the agitator, having the least inertia, and basket movement is at a minimum since it has a large inertia. The ratio of agitator rotational inertia to basket rotational inertia corresponds directly to the ratio of agitator rotation to basket rotation, through gear cse reduction ratio. As clothes are added to the washer, those clothes are carried by the agitator, thus adding to the torque load of the agitator and thus increasing the rotational inertia of the agitator, thereby increasing the portion of the drive torque going to the basket. This increases the angular movement of the basket. As still further clothes are added, coupling between the agitator and basket through the clothes causes less excursion of the basket. That is, the basket inertia increases relative to the agitator inertia. As still more clothes are added, clothes see "longer" stroke angles because of coupling of the clothes to the wash basket. The combination of the rotational angles of the agitator and basket corresponding to the motor shaf angle, becomes the effective or total relative stroke angle even though the agitator is driven through a much shorter stroke angle. Thus, there is no decrease in mechanical agitation even if there is a decrease in the stroke angle of the agitator. This provides for reuuced energy consumption for a given effective stroke angle.

Figure 10:
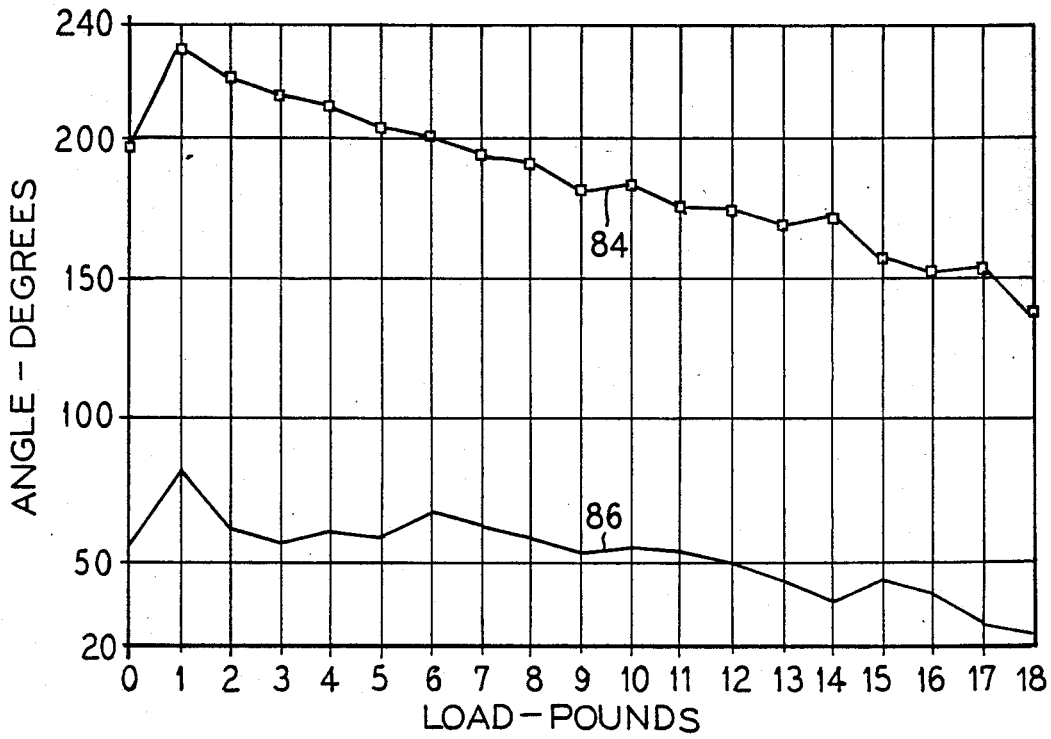
FIG. 10 is a graphic comparison of stroke angles of the agitator and rotation of the basket for varying sized loads.
Figure 11:
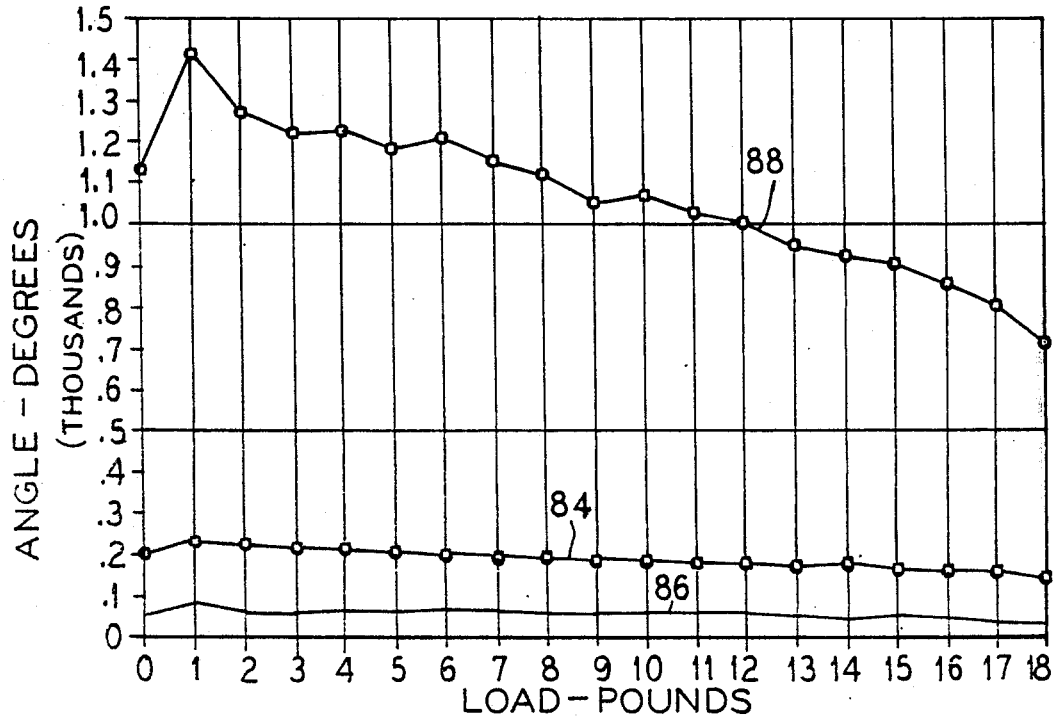
FIG. 11 is a graphic comparison of motor shaft rotation to the agitator and basket rotation of FIG. 10.

FIG. 10 is an empirical comparison of agitator rotation illustrated by line 84 and basket rotation illustrated by line 86 for increasing load sizes. FIG. 11 again shows agitator and basket rotation as well as motor angle at line 88. It can be seen that at high load levels, although the motor is stressed, the rotational angles of the basket and agitator do not decrease dramatically.

Since there is no restrait placed on the wash basket and ring gear, the shock loading on the gears is greatly lessened and tub motion is eliminated.

As is apparent from the foregoing specification, the invention is susceptible of being embodied with various alterations and modifications which may differ particularly from those that have been described in the preceeding specificatoon and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. An automatic washer for subjecting a fabric load to a series of washing, rinsing and liquid extraction steps, said washer comprising:

a basket for receiving said fabric load rotatably mounted within a cabinet, said cabinet having an openable lid providing access to the interior of said basket;

an agitator centrally mounted within said basket, being free to rotate relative to said basket;

a reversible drive system including a motor;

drive means operatively connected between said reversible drive system and said basket and agitator for selectively rotationally driving said basket and agitator in an opposite oscillatory manner;

said drive means comprising a planetary drive arrangement wherein said motor has an output shaft which is connected to a sun gear, said agitator is connected to at least one planet gear and said basket is connected to a ring gear.

2. The automatic washer as defined in claim 1, wherein said motor in said reversible drive system comprises a reversible motor.

3. The automatic washer as defined in claim 2, wherein said motor comprises a permanent split capacitor mtoor.

4. The automatic washer as defined in claim 1, wherein said drive means is additionally operatively connected between said reversible drive system and said basket and agitator for selectively rotationally driving said basket and agitator in a common spinning manner.

5. The automatic washer as defined in claim 4, wherein said drive means comprises a clutch mechanism to selectively change the drive of said basket from opposite that of said agitator to common with that of said agitator.

6. The automatic washer as defined in claim 1, wherein said drive means comprises a common drive clutch means to selectively change the drive of aaid basket from opposite that of said agitator to common with that of said agitator.

7. The automatic washer as defined in claim 6, wherein said common drive clutch means comprises an axially displaceable gear member having teeth on an outer crrcumference thereof which engage with corresponding teeth on an annular axial extension of the ring gear, and teeth on an inner circumference thereof which engage with outwardly projecting teeth carried on said motor output shaft to selectively lock and unlock said ring gear and output shaft.

8. The automatic washer as defined in claim 1, including a brake mechanism operative when said lid is open to arrest rotational movement of said basket.

9. An automatic washer as defined in claim 1, wherein said drive means comprises a clutch mechanism to selectively change the drive of said basket from opposite that of said agitator to common with that of said agitator.

10. An automatic washer for subjecting a fabric load to a series of washing, rinsing and liquid extraction steps, said washer comprising:

a basket for receiving said fabric load rotatably mounted within a cabinet, said cabinet having an openable lid providing an access to the interior of said basket;

an agitator centrally mounted within said basket, being free to rotate relative to said basket;

a reversible drive system including a motor;

drive means operatively connected between said reversible drive system in said basket and agitator for selectively rotationally driving said basket and agitator in an opposite oscillatory manner, said drive means comprising a clutch mechanism to selectively change the drive of said basket from opposite that of said agitator to common with that of said agitator, said drive means including an output shaft on said motor and said clutch mechanism comprising a gear member axially movable on said output shaft between an engaged position and a disengaged position, in said engaged position said gear member serving to provide a direct rotational drive connection between said motor and said basket.

11. The automatic washer as defined in claim 10, wherein said clutch mechanism further includes an actuator mechanism to move said gear from said engaged position to said disengaged position and a spring member for biasing said gear toward said engaged position.

12. The automatic washer as defined in claim 1, including a brake mechanism operative when said lid is open to arrest rotational movement of said basket.

13. A drive system for an automatic washer having a basket rotatably carried on a washer frame for receiving a fabric load and a vertical axis agitator centrally mounted within said basket comprising:

means for oscillatingly driving said agitator during a washing mode; and means for oscillatingly driving said basket in a reverse direction to that of said agitator in said washing mode;

said means for oscillatingly driving said agitator comprising a motor operatively connected to said agitator, said motor being reversely operatable;

said means for oscillatingly driving said basket comprising a gearing connection between said motor and said basket which causes a rotational driving of said basket opposite to that of said agitator, including an output shaft on said motor and a planetary gear system wherein a sun gear is coupled to said output shaft, at least one planet gear is connected to said agitator and a ring gear is connected to said basket.

14. The drive system according to claim 13 further including means for corotating said basket and agitator during a liquid extraction mode.

15. An automatic washer for subjecting a fabric load to a series of washing, rinsing and liquid extraction steps, said washer comprising:

a basket for receiving said fabric load rotatably mounted within a cabinet, said cabinet having an openable lid providing access to the interior of said basket;

an agitator centrally mounted within said basket, being free to rotate relative to said basket;

a reversible drive system including a motor;

drive means operatively connected between said reversible drive system and said basket and agitator for selectively rotationally driving said basket and agitator in an opposite oscillatory manner;

said drive means comprising a plurality of coaxially rotating gear members connected to said motor, said agitator and said basket.

* * * * *